US005208070A

United States Patent [19]

Johnson et al.

[11] Patent Number: 5,208,070

[45] Date of Patent: May 4, 1993

[54] METHOD OF ALUMINUM PLATING AN ARTICLE

[75] Inventors: Robert W. Johnson, Bedworth; Ian K. Gillett, Birmingham; Paul S. J. Magrath, Daventry; Colin R. Weaver, Kenilworth, all of England

[73] Assignee: Rolls-Royce Plc, London, England

[21] Appl. No.: 684,383

[22] Filed: Apr. 12, 1991

[30] Foreign Application Priority Data

Apr. 17, 1990 [GB] United Kingdom ..... 9008626

[51] Int. Cl.[5] ..... C23C 16/08; C23C 16/12

[52] U.S. Cl. ..... 427/252; 427/253; 118/717; 118/724; 118/726

[58] Field of Search ..... 427/252, 253; 118/717, 118/724, 726

[56] References Cited

U.S. PATENT DOCUMENTS

| | | | |
|---|---|---|---|
| 3,515,095 | 6/1970 | Baranow et al. | 118/48 |
| 3,640,815 | 2/1972 | Schwartz et al. | 204/38 S |
| 4,041,196 | 8/1977 | Baldi et al. | 427/252 |
| 4,156,042 | 5/1979 | Hayman et al. | 427/253 |
| 4,569,862 | 2/1986 | Arai et al. | 427/255 |

FOREIGN PATENT DOCUMENTS

| | | |
|---|---|---|
| 425388 | 3/1935 | United Kingdom . |
| 777833 | 4/1955 | United Kingdom . |
| 1043579 | 9/1966 | United Kingdom . |
| 1543704 | 4/1979 | United Kingdom . |

*Primary Examiner*—Michael Lusigan
*Assistant Examiner*—Bret Chen
*Attorney, Agent, or Firm*—Oliff & Berridge

[57] ABSTRACT

A crucible used in a powder pack plating process has an aperture below the upper surface of the powder pack to allow a density driven flow of the plating gas generated by the powder pack to move through the powder pack.

2 Claims, 3 Drawing Sheets

METHOD OF ALUMINUM PLATING AN ARTICLE

FIELD OF THE INVENTION

This invention relates to a pack plating process, particularly a pack aluminising process.

A pack plating process is a process where the surfaces of objects are plated with metal by heating them with a metalising powder pack.

DESCRIPTION OF THE PRIOR ART

A conventional pack aluminising process is shown diagrammatically in FIG. 1. An object to be aluminised, for example a gas turbine blade 1, is placed in a powder pack 2 formed by a shallow open topped tray 3 containing a quantity of aluminising powder 4. This is carried out by putting the blade horizontally on top of a layer of aluminising powder 4 in the tray 3 and then adding further aluminising powder 4 to cover the blade 1. The blade 1 is laid horizontally in order to minimise the total mass of the powder pack 2 and the thickness of the powder 4 around the blade 1 in order to minimise the thermal response time of the powder pack 2.

The aluminising powder 4 is a mixture of metallic aluminium, a volatile halide and a refractory bulking agent such as aluminium oxide.

The powder pack 2 is then placed inside a retort 5 which is sealed, apart from an inlet port 6 and an outlet port 7 at the bottom and top of the retort 5 respectively.

Argon gas is pumped into the retort 5 through the lower inlet port 6. Argon is denser than air and so displaces the air within the retort upwards and out of the upper outlet port 7.

When all the air has been flushed out of the retort 5 a flow of argon is maintained and the retort 5 is heated.

This heating causes the metallic aluminium and the volatile halide to react to produce aluminium halide gas within the aluminising powder 4, where this gas contacts the blade 1 it decomposes, depositing a layer of aluminium on the surface of the blade 1. The aluminium halide gas is denser than argon or air and so it displaces the argon and any air trapped in the powder from the tray 3.

It is essential to purge the air from the retort 5 because the aluminium halide gas is a powerful reducing agent and would decompose on contact with the oxygen in the air.

There is a problem with such a system. If the object to be aluminised has narrow holes in it, such as cooling air channels in a gas turbine blade, the aluminium halide gas tends not to penetrate very far down the narrow holes or channel and as a result the inner surfaces of such holes can prove to be unplateable, or plateable only by keeping the powder pack in a heated retort for an unacceptable length of time.

BRIEF SUMMARY OF THE INVENTION

In its broadest sense this invention provides a pack plating process in which a density driven flow of plating gas passes through the pack. The invention also provides a crucible for use in powder pack plating having an aperture below the upper surface of the powder pack and a process for using it.

A first aspect of this invention provides a pack plating process in which a density driven flow of a plating gas passes through the powder pack throughout the plating process.

A second aspect of this invention provides a pack plating process in which an object to be plated and a plating powder pack are heated in a crucible having an aperture below the upper surface of the powder pack.

In a third aspect this invention provides apparatus for pack plating comprising a crucible containing an object to be plated and a plating powder pack, the crucible having an aperture below the upper surface of the powder pack.

In all aspects of the invention a density driven flow through the powder pack of the plating gas generated by the powder pack occurs. In the second and third aspects of the invention this flow is produced as a result of the provision of the aperture. It is preferred that the aperture be below the object to be plated and at the bottom of the crucible so that this flow passes over the whole of the object to be plated and through all of the powder pack.

Where the object to be plated has a channel passing through it and it is desired to plate the walls of this channel it is preferred to arrange the object so that the plating gas flow passes down the channel. To allow this, the object should be placed so that the channel is not horizontal, or best of all is vertical.

BRIEF DESCRIPTION OF THE DRAWINGS

Pack plating systems embodying the invention will now be described by way of reference only, with reference to FIGS. 2 to 5 of the accompanying diagrammatic drawings, in which.

DETAILED DESCRIPTION

Figure 1:
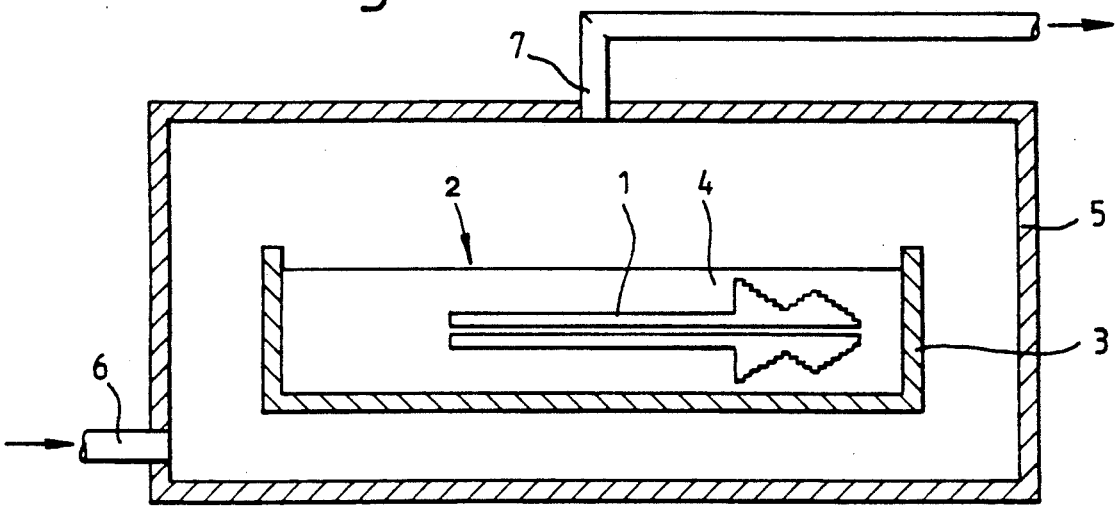
FIG. 1 shows a conventional pack aluminising apparatus.
Figure 2:
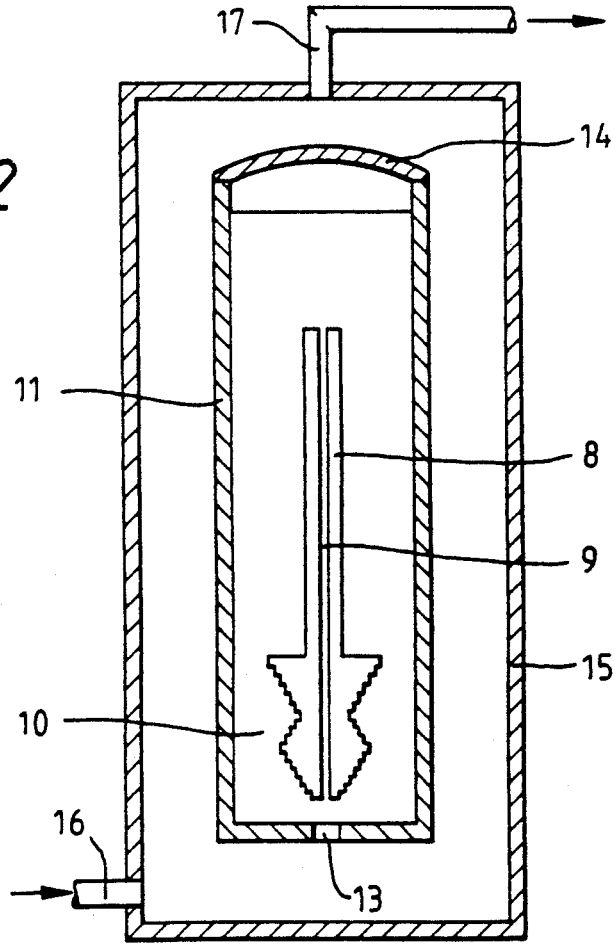
FIG. 2 shows a cross section through plating apparatus employing a first crucible and a first process according to the present invention.

Referring to FIG. 2 a gas turbine blade 8 having an internal cooling passage 9 running lengthways through it is to be aluminised over its external surface and internally on the walls of the cooling passage 9.

The blade 8 is placed vertically on top of a layer of conventional aluminising powder 10 in a crucible 11. More aluminising powder 10 is then added to cover the blade 8.

The crucible 11 has a hole 13 in its base and when all of the aluminising powder 10 has been added a lid 14 is fitted over the top of the crucible 11.

The crucible 11 is then placed in a retort 15 which is sealed apart from an inlet port 16 and an outlet port 17 at the bottom and top of the retort 15 respectively.

The retort 15 is then flushed with argon pumped into the retort 15 through the lower inlet port 16. This displaces the air within the retort 15 out through the upper outlet port 17. After this initial flushing a flow of argon is maintained through the retort 15.

The retort 15 is then heated so that the aluminising powder 10 reacts to generate an aluminium halide plating gas. The aluminium halide gas produced is denser than both air and argon and as a result flows downward through the aluminising powder and out through the hole 13 in the base of the crucible 11. The lid 14 increases this flow by reducing the amount of aluminium halide gas escaping from the upper surface of the aluminising powder 10.

The aluminium halide gas escaping through the hole 13 is entrained in the argon flow through the retort 15 and is carried with this argon flow out of the upper outlet port 17.

The aluminium halide gas flowing through the aluminising powder 10 decomposes on contact with the surface of the turbine blade 10 and deposits a layer of aluminium on the blade surface. Additionally, as the aluminium halide gas flows downwards through the aluminium powder 10 some of it flows into and along the internal cooling passage 9 within the turbine blade 8. The aluminium halide gas flowing along the internal cooling passage 9 decomposes on contact with the walls of the internal cooling passage 9 and deposits a layer of aluminium on them.

If the grain size of the aluminising powder 10 or the grain sizes of any of its constituents are equal to or smaller than the width of the internal cooling passage 9 a problem can arise due to the aluminising powder 10 entering the cooling passage 9. Any grains of the aluminising powder 10 inside the cooling passage 9 may stick together or to the walls of the cooling passage 9 when the retort 15 is heated and form an obstruction in the cooling passage 9.

Figure 3:
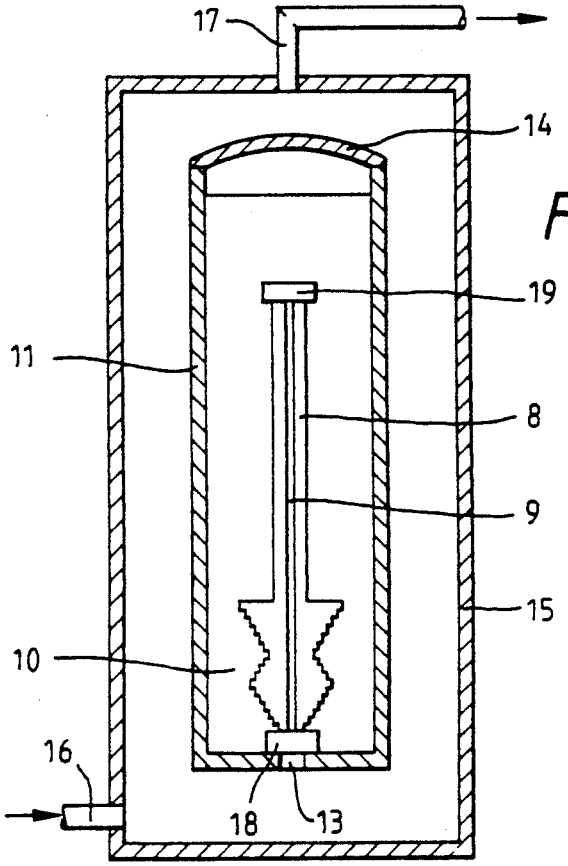
FIG. 3 shows a cross section through plating apparatus using the crucible of FIG. 1 and a second process according to the present invention.

In order to prevent this the arrangement shown in FIG. 3 is used. In this a gas turbine blade 8 is placed on top of a first block 18 of a porous refractory material on the bottom of the crucible 11. A second block 19 of a porous refractory material is then placed on top of the blade 8. After this the process is carried out in the same way as in the previous example, aluminising powder is poured into the crucible 11 to cover the blade 8 and the second block 19, and a lid 14 is placed on the crucible 11. The crucible 11 is then placed in a retort 15 which is flushed with argon and then heated.

The first and second blocks 18 and 19 are porous and so allow the aluminium halide gas to flow downwards through the aluminising powder 10 and through the cooling passage 9. This allows the aluminising process to operate as before, but the blocks 18 and 19 prevent the aluminising powder 10 getting inside the cooling passage 9 because the aluminising powder 10 cannot pass through them.

Figure 4:
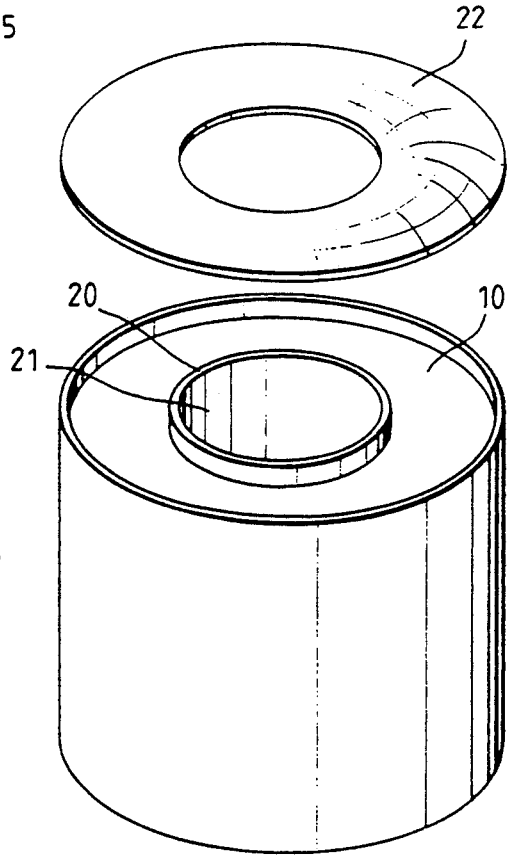
FIG. 4 shows a perspective view of a second crucible according to the present invention.
Figure 5:
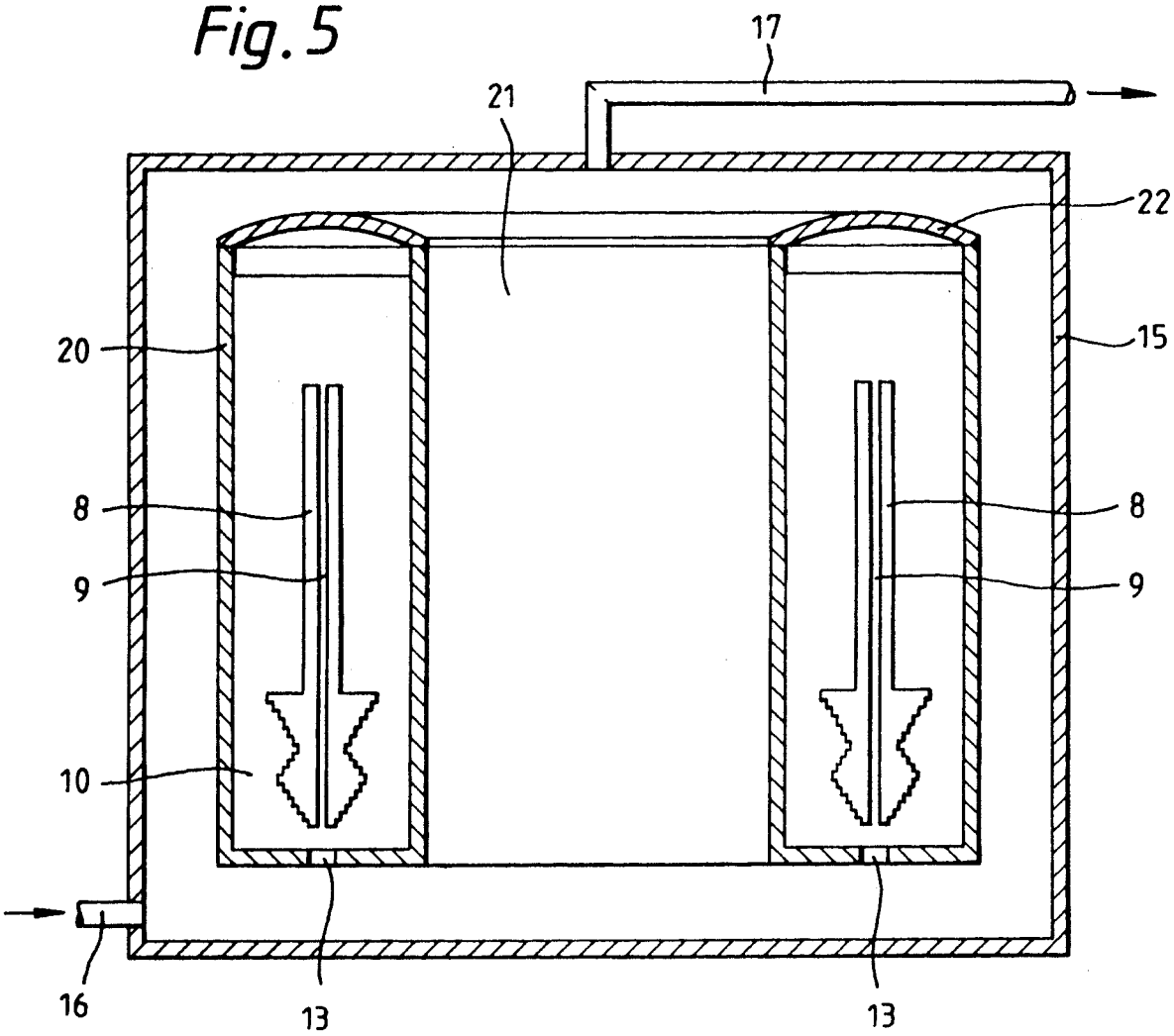
FIG. 5 shows a cross section through the crucible of FIG. 4 used in a first process according to the present invention, similar parts having the same reference numerals throughout.

In order to make efficient use of retort space and simplify handling it is useful to simultaneously aluminise a number of blades 8 in a single crucible 20, as shown in FIGS. 4 and 5.

The crucible 20 is in the shape of an annular trough having a circular central aperture 21. There are a plurality of holes 13 evenly spaced around the bottom of the crucible 20, and an annular lid 22 fits over the top of the crucible 20. The crucible 20 is shaped as an annulus to minimise its mass and thermal response time and so speed the aluminising process.

In use, a plurality of turbine blades 8 are placed on top of a layer of aluminising powder 10 which is on the bottom of the crucible 20. More aluminising powder 10 is then poured into the crucible 20 to cover the blades 8 and the annular lid 22 is placed on top of the crucible 20.

The crucible 20 is then put into a retort 15 as before and the retort 15 is flushed with argon and then heated.

The aluminium halide gas produced flows down through the aluminising powder 10 and cooling passages 9 as before, the only difference being that it leaves the crucible 20 through a plurality of holes 13 instead of only one.

It has been found that by using these techniques, as well as allowing plating of the insides of relatively narrow holes, the rate of plating of the outside of objects placed in the aluminising powder 10 can be increased, for a given temperature over time profile. It is believed that it is because in the prior art aluminising process air trapped between the grains of the aluminising powder will not be displaced by argon unless the powder pack is allowed to stand in the argon atmosphere within the retort for a very long time. Generally waiting for such a long time will make an industrial plating process unacceptably slow and as a result when the prior art powder pack is heated the aluminium halide gas produced immediately comes into contact with this trapped air and reacts with the oxygen in the air, destroying the aluminium halide gas and so reducing the amount of aluminium halide gas which comes into contact with the object to be plated.

Using a crucible with a hole in its bottom, the aluminium halide gas produced, being denser than either air or argon, will flow downwards and drive any trapped air or argon out of the hole. As a result any trapped air is rapidly removed so no oxygen remains within the powder pack to react with and reduce the concentration of the aluminium halide gas.

It is not essential to use a lid on top of the crucible. However, if a lid is not used the aluminium halide gas produced toward the top of the aluminising powder tends to diffuse upwards and into the argon above the aluminising powder and is then entrained by the argon gas flow through the retort and carried away. As a result it has been found that in order to produce the same aluminium halide gas concentration around the object a greater depth of aluminising powder must be used above it. This increases the bulk and thermal mass of the powder pack, both of which increases are undesirable, and so it is preferred to use a lid.

In practice a number of crucibles 11 or 20 may be simultaneously used in a single retort.

This invention can be applied to any pack plating process, such as boronising or siliconising as well as aluminising, by use of appropriate plating powder mixtures. Gases other than argon could be used for purging, providing that they did not react undesirably with the plating powder or plating gases evolved.

Although the processes above are described using separate retorts and crucibles, it would of course be possible to use a crucible which is integral with a retort, or to place a crucible in a controlled atmosphere furnace.

We claim:

1. A method of aluminum plating an article comprising the following steps:

(a) providing an aluminising powder consisting of metallic aluminum, a volatile halide, and a refractory bulking agent;

(b) providing a crucible adapted to receive the article, the crucible having a top closure member and an aperture in its base;

(c) providing a retort adapted to receive the crucible, the retort having an inlet port and an outlet port whereby an inert gas may be flushed through the retort, the retort being otherwise sealable;

(d) placing the article in the crucible, completely covering the article within the crucible with the aluminising powder, and closing the top of the crucible after the article and aluminising powder have been placed therein;

(e) placing the crucible in the retort;

(f) sealing the retort except for the inlet and outlet ports;

(g) pumping an inert gas into the retort through the inlet port so as to displace air from the retort;

(h) heating the retort so as to react the aluminum with the halide and thereby produce an aluminum halide gas which descends through the crucible and decomposes on contact with the article to deposit a layer of aluminum thereon, excess aluminum halide gas escaping through the aperture in the base of the crucible; and (i) maintaining a flow of inert gas through the retort so as to entrain excess aluminum halide escaping from the base of the crucible.

2. A method as claimed in claim 1, wherein the article is an article having a channel through it, the method replacing step (d) of claim 21 by:

(a) providing first and second porous refractory members adapted to close respective ends of the channel;

(b) closing the ends of the channel with the refractory members; and (c) placing the article with the closed channel in the crucible so that the channel is substantially vertical and completely covering the article within the crucible with the aluminising powder, whereby in steps (h) and (i) of claim 21 the refractory members prevent the aluminising powder from entering the channel but permit the passage of aluminum halide gas through the channel.

* * * * *